United States Patent [19]

Allen

[11] Patent Number: 4,948,075

[45] Date of Patent: Aug. 14, 1990

[54] RETENTION RING ASSEMBLIES FOR SUPPORTING REFUSE BAGS

[76] Inventor: Johnny G. Allen, 603 Cedar Ave., P.O. Box 3667, Albany, Ga. 31706

[21] Appl. No.: 380,447

[22] Filed: Jul. 17, 1989

[51] Int. Cl.[5] ..... A63B 55/04

[52] U.S. Cl. ..... 248/97; 248/95; 248/175; 248/907

[58] Field of Search ..... 248/907, 95, 97, 98, 248/99, 100, 101, 175; 220/404; 141/314, 391

[56] References Cited

U.S. PATENT DOCUMENTS

| | | | |
|---|---|---|---|
| D. 276,755 | 12/1984 | Eads et al. . | |
| 313,515 | 3/1885 | Parker . | |
| 432,966 | 7/1890 | Allen . | |
| 611,498 | 9/1898 | Lyon . | |
| 936,975 | 10/1909 | Abel | 248/99 X |
| 972,870 | 10/1910 | Kandlbinder . | |
| 1,548,986 | 8/1925 | Donovan . | |
| 3,079,119 | 2/1963 | Brooks | 248/907 X |
| 3,135,391 | 6/1964 | Umstead | 248/907 X |
| 3,141,644 | 7/1964 | Baird | 248/907 X |
| 3,684,225 | 8/1972 | Crawford et al. . | |
| 3,754,771 | 8/1973 | Shagoury | 248/98 X |
| 3,841,592 | 10/1974 | Witten | 248/98 X |
| 3,933,328 | 1/1976 | Michelbrink | 248/907 X |
| 3,991,961 | 11/1976 | Platzer, Jr. . | |
| 3,992,034 | 11/1976 | Smith, Sr. et al. | 248/98 X |
| 4,124,185 | 11/1978 | Preisinger | 248/98 |
| 4,498,652 | 2/1985 | Malik . | |
| 4,579,307 | 4/1986 | Malik . | |
| 4,702,445 | 10/1987 | Ivory . | |
| 4,708,307 | 11/1987 | Daigle | 248/97 |

FOREIGN PATENT DOCUMENTS

| | | | |
|---|---|---|---|
| 0163167 | 6/1955 | Australia | 248/97 |

*Primary Examiner*—Ramon O. Ramirez
*Attorney, Agent, or Firm*—Dowell & Dowell

[57] ABSTRACT

Retention ring assemblies for supporting one or more refuse, garbage or lawn and garden bags so that such bags are retained in an open configuration and vertically stabilized to thereby facilitate the filling of the bags and wherein the assemblies include ring members which are cantilevered from offset horizontal support racks which may be free standing or suspended from other structures.

10 Claims, 5 Drawing Sheets

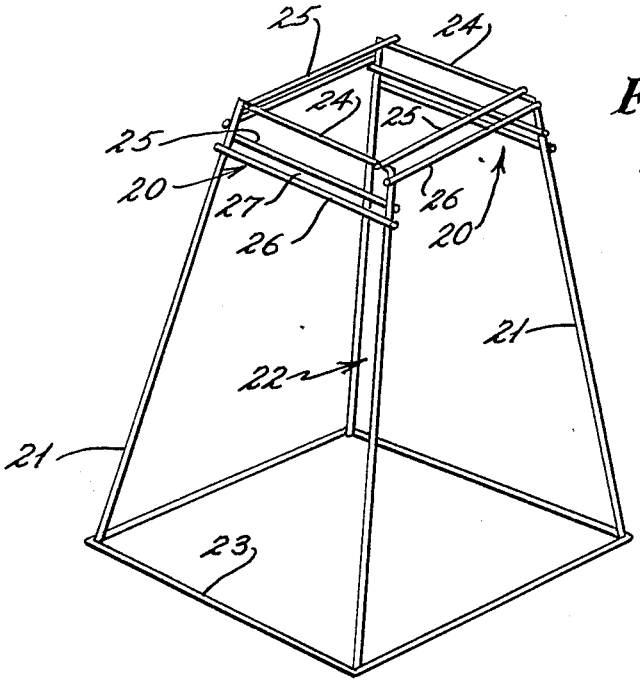
Fig.1
Fig.2
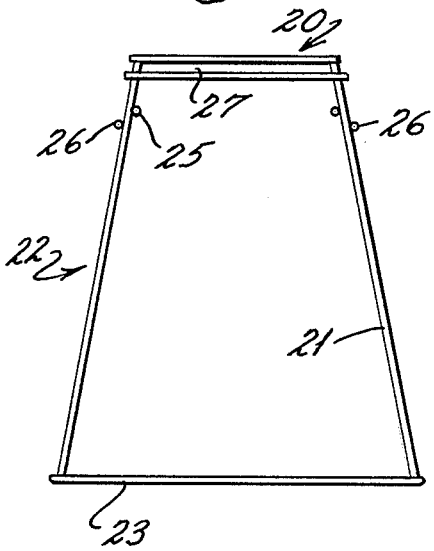
Fig.3
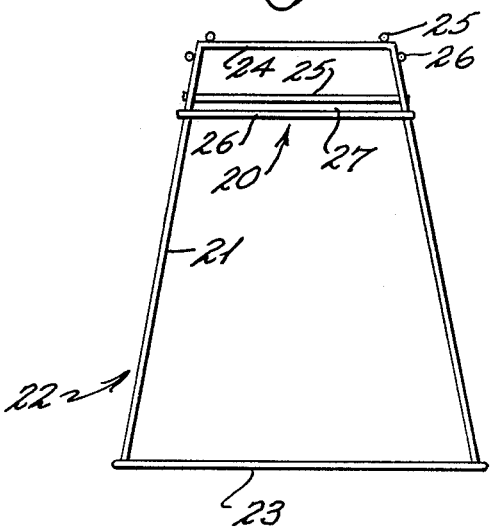

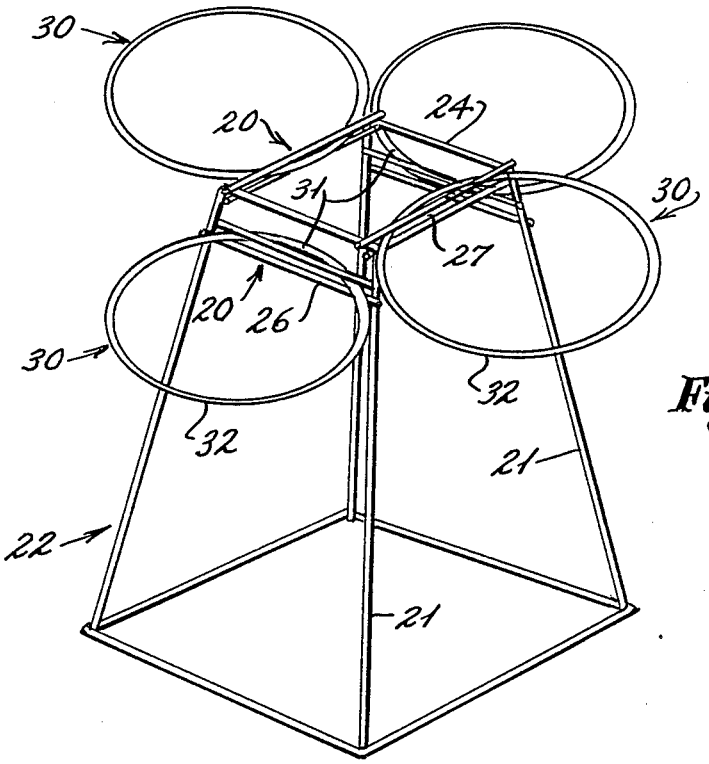
Fig. 4
Fig. 5
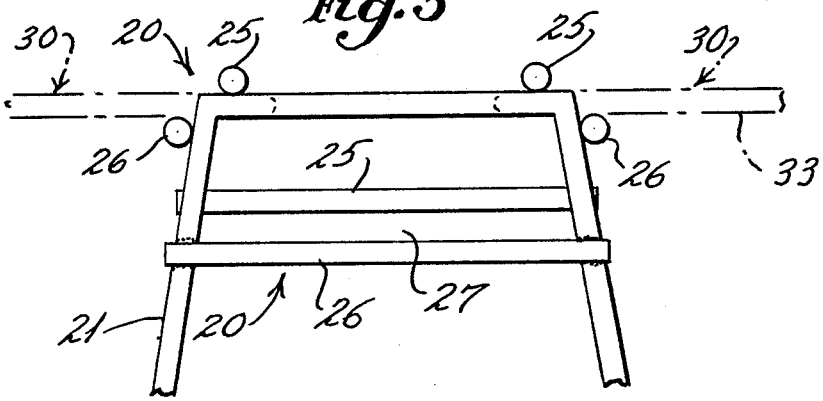
Fig. 6
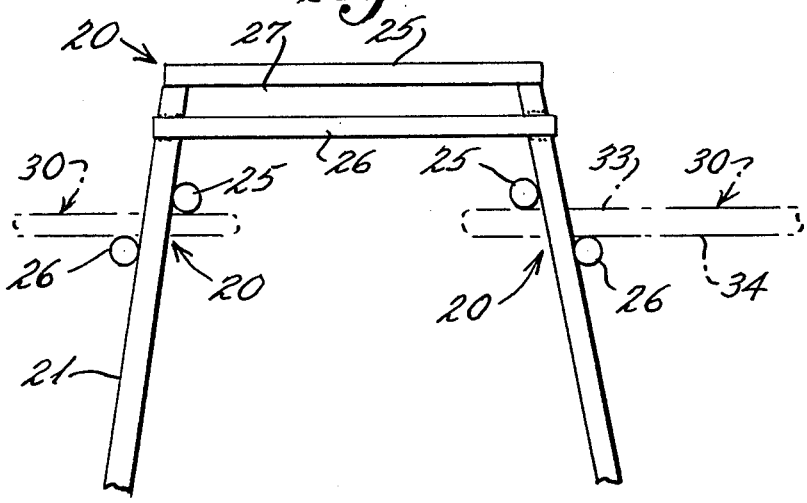

RETENTION RING ASSEMBLIES FOR SUPPORTING REFUSE BAGS

BACKGROUND OF THE INVENTION

1. Field of the Invention

This invention is generally directed to bag holders of the type which are utilized to support flexible bags in an open configuration so as to facilitate the filling of the bags and more specifically to retention ring assemblies for supporting one or more refuse, garbage or lawn and garden bags relative to a support surface in such a manner that the support rings which retain the bags in open configuration may be stored in an out of the way location when not in use and may be easily placed within a support rack wherein the rings are cantilevered from the rack in such a manner that the rings are supported without the need for providing additional fastening elements to support the rings relative to the rack or a structure to which the rack is mounted. The racks include a pair of vertically spaced members which are disposed in generally parallel planes and which may include either elongated rod members or circular members which are also horizontally offset with respect to one another so as to provide a pair of spaced contact points which engage the support rings at spaced locations along the periphery thereof so that the weight of the rings is utilized to secure the rings within the racks. In this manner, rings may be removed by simply elevating the outer portion of the rings which is cantilevered with respect to the support members and thereafter withdrawing the rings from the pair of spaced members forming the mounting rack.

In one embodiment of the present invention, the racks may be formed by elongated spaced rod members which are provided with hook elements which support the rod members relative to a support surface such as a fence, doorknob or similar structure so that the retention ring assemblies may be supported in an area where it is necessary to provide easy access to fill a refuse, garbage or lawn and garden bag. In yet another embodiment of the present invention, the support racks may be suspended from the handle of a lawn mower or other object by providing an elongated support or hanger member which is connected at its ends with the uppermost of the members forming the support rack. In this respect, lawn and garbage bags may be suspended from the handle of conventional lawn mowers so as to facilitate the filling of lawn and garbage bags with cut grass and other lawn and garden debris.

In yet another embodiment of the present invention, the retention ring assemblies may be supported by rack configurations which are designed to be cooperatively seated on the upper rim of a conventional garbage can. In this manner, a plurality of separate bags and support rings may be cantilevered from the support racks so that a plurality of garbage bags may be filled while the racks are supported by the conventional garbage can.

In yet a further embodiment of the present invention, the retention ring assemblies may include support racks which are themselves free standing and which form the base for supporting conventional garbage containers so that the garbage containers are not only supported so that the containers will not be easily overturned but so that the support racks forming the retention ring assemblies may be utilized to fill garbage bags which will thereafter be placed within the garbage cans supported on the retention ring assembly stands.

2. History of the Related Art

Over the years there have been numerous structures designed and constructed for facilitating the use of various types of bags including garbage bags, lawn and garden bags and the like. The opening to such flexible type of bags and containers is often difficult to retain open while attempting to load substantial amounts of materials into the bags. This is particularly true in uses such as lawn and garden care wherein armfuls of leaves, cut grass, weeds and the like are to be loaded within the bags for subsequent disposal. Some early examples of ring type structures which operate as bag holders are disclosed in U.S. Pat. No. 313,515 to Parker, U.S. Pat. No. 432,966 to Allen, U.S. Pat. No. 611,498 to Lyon and U.S. Pat. No. 1,548,986 to Donovan. In each of these prior art bag holders, a ring element or semi-circular ring element is provided which is secured to a mounting base portion that extends from the ring element or semi-circular ring element to a support which may be selectively secured to a given surface. In the reference to Parker, the ring or bag holder must be uniquely configured so as to be engageable over a support surface and therefore is provided with inverted U-shaped end portions which are joined by a connecting bracket. The U-shaped end portions may be mounted over a rail or other element so that the bag holder may be suspended horizontally with respect thereto. Such a structure is limited in its usefulness in that an appropriate horizontal support must be available on which the U-shaped mounting portions of the bag holder may be selectively seated so as to retain the ring portion of the bag holder in a selected horizontal position. Further, when the ring element of the bag holder is not in use, the U-shaped mounting portions will extend from the ring element thereby making storage somewhat difficult.

In the structure disclosed in the reference to Allen, a generally U-shaped bag holder element is selectively inserted within a pair of adjustable brackets which may be disposed over a horizontal rail in a manner similar to that disclosed in the reference to Parker. Again, the use of the bag holder is limited to the type of support surface which is available with such support surface not necessarily being conducive to use in supporting bags in various environments such as in an area where no fence or other horizontal rail is available. Also, the support brackets in which the U-shaped bag holder is selectively inserted require additional structure which adds to the cost of the bag holder which decreases the availability of such a product for the average consumer.

In the reference to Lyon, the generally circular shaped bag holding element is mounted to a special bracket which is suspended from a hook type of support which is specifically provided to support the bracket and ring relative to a base. With this type of structure, the ring element must again be provided with a fixed type of mounting bracket that is secured to the ring so that the ring may be selectively secured to a supplemental mounting structure. In view of the foregoing, whenever the ring element is not in use, the support bracket is always attached thereto. A similar arrangement is disclosed in the reference to Donovan wherein the ring shaped element is mounted to a generally U-shape mounting bar which is fitted within an especially configured bracket that may be secured to a vertical support surface. With this structure, not only is it necessary to provide the ring member for insuring the open configuration of the bag supported from the ring, but it is also necessary to provide the U-shaped bracket which fits within a supplemental bracket that is secured to the support surface.

A variation of bag holder is disclosed in U.S. Pat. No. 972,870 to Kandlbinder. In this type of bag holder, as opposed to using a circular or ring element to support the opening of the bag, a spring loaded wire member is provided having a pair of outwardly extending arms which are yieldable with respect to one another. The arms are engageable along opposite sides of the bag so as to deflect the bag outwardly. This type of holder will tend to provide an uneven opening for the mouth of the bag as opposed to the ring type holders as disclosed in the prior art discussed above. In addition, a special type of support must be provided to retain the end of the spring arms relative to a given surface. Another wire rack type configuration for supporting bags in an open configuration is disclosed in U.S. Pat. No. 4,498,652 to Malik. In this configuration, a generally rectilinear wire frame is supported by a pair of hook elements that are secured to the interior door of a cabinet or other structure so that the bag may be supported from the door in an open configuration. With this type of structure, the mounting of the rack with respect to the door requires that some modification be made to the door such as by providing securing elements for engaging the ends of the rack to the door. Such a fixed mounting arrangement may present drawbacks to the use of the bag holder.

In addition to the foregoing, carriers for bag holders have also been made so that the bags supported by the holders may be manipulated without requiring an individual to lift and tote the bag. In U.S. Pat. No. 3,754,771 to Shagoury and U.S. Pat. No. 4,124,185 to Preisinger, bag holders are disclosed which are mounted to transport dollies. The transport dollies are provided with wheels so that the dollies may be easily transported across an individual's lawn or yard. With these types of holders, a ring element is either fixedly mounted, as in the case of the patent to Shagoury, to the dolly frame or is removably mounted as is disclosed in the patent to Preisinger. However, as was discussed above with respect to the earlier bag holders, each of the ring elements of the mobile bag holders must be mounted to a supplemental bracket and the supplemental bracket is thereafter secured to the frame of the dolly. Such additional structure adds to the expense of the bag holder and also complicates the storage of the bag support rings when the rings are not in use.

Some additional examples of prior art bag holders are disclosed in U.S. Pat. No. DES 276,755 to Eads et al, U.S. Pat. No. 3,991,691 to Platzer, Jr., U.S. Pat. No. 3,684,225 to Crawford et al, U.S. Pat. No. 4,579,307 to Malik and U.S. Pat. No. 4,702,445 to Ivory. In view of the foregoing, there are several areas in which the prior art bag holders have not been designed to provide sufficient flexibility to allow their use in environments where it is not possible to effectively fixedly or permanently mount the bag holders to a support surface and wherein no attempt has been made to utilize existing containers and lawn and garden equipment to be utilized to support bag holders in areas where the bag holders are to be utilized.

SUMMARY OF THE INVENTION

This invention is directed to retention ring assemblies for supporting one or more refuse, garbage or lawn and garbage bags so the bags are retained in an open configuration and stabilized vertically with respect to an existing support surface such as a fence, door, garbage can, lawn mower or other utility vehicle and wherein the retention ring assemblies include mounting brackets for selectively receiving bag support rings which are cantilevered from the racks in such a manner that the rings may be conveniently removed and/or installed without the use of supplemental clamps or supporting elements. The retention ring assemblies further include racks which incorporate a pair of vertically spaced ring abutment members which are horizontally offset with respect to one another with the uppermost abutment member being generally spaced closer to an existing support structure than the lower of the abutment members. The vertical spacing between the abutment members may be varied in order to change the incline of the bag support rings with respect to the mounting brackets.

In some embodiments of the present invention, one or more hooks may be secured to the support brackets so that the brackets may be suspended from an existing structure such as a fence, doorknob or the like. In another embodiment of the present invention, a hanger element may be secured to the support brackets so that the support brackets may be slidingly engaged so as to depend from the handle of a conventional lawn mower or garden tractor.

In yet a further embodiment of the present invention, the support brackets which retain the bag support rings of the present invention may be selectively utilized in cooperation with conventional trash cans or trash can holders.

In each embodiment of the present invention, whenever it is desired to use a ring to support a bag in an open configuration, such ring may be utilized without a plurality of connectors with the rings being simply secured under the influence of gravity to the support brackets which are selectively engageable to existing structures without requiring modification to such an existing structure.

BRIEF DESCRIPTION OF THE DRAWINGS

FIG. 1 is a perspective view of a first embodiment of the present invention showing a base assembly for storage of conventional garbage cans wherein the base includes four ring support brackets oriented in generally rectilinear relationship with respect to one another.

FIG. 2 is a side elevational view of the embodiment of the invention shown in FIG. 1.

FIG. 3 is a front plan view of the embodiment of the invention shown in FIG. 1.

FIG. 4 is a perspective illustrational view of the embodiment of the invention shown in FIG. 1 wherein four bag support rings are selectively mounted or suspended from the four support racks of the base assembly.

FIG. 5 is an enlarged partial illustrational view showing the cantilevered relationship of two of the rings of the embodiment shown in FIG. 4.

FIG. 6 is an enlarged illustrational view taken from the side of the embodiment shown in FIG. 4 illustrating the cantilevered relationship of the lower rings with respect to the base assembly.

DESCRIPTION OF THE PREFERRED EMBODIMENT

Figure 7:
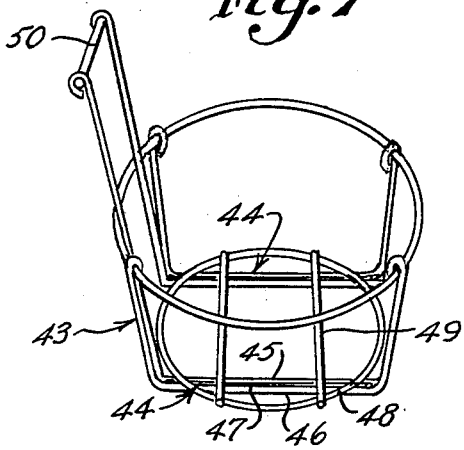
FIG. 7 is a second embodiment of the invention showing a rack for supporting a conventional garbage can which can be mounted to a base similar to that shown in FIG. 1 or a base similar to that illustrated in FIG. 8 wherein the bottom portion of the rack includes a pair of oppositely oriented support brackets in accordance with the teachings of the present invention and wherein a single ring is disclosed in dotted line extending from one of the support brackets.

As has been previously discussed, the primary elements of the present invention are embodied within one or more generally annular rings to which the mouth of an open container such as a lawn and garden or trash bag may be selectively secured such as by utilizing clothes line pins, clamps and the like. Each of the ring elements is selectively mounted within mounting brackets which are either fixedly secured to an independent support or which are selectively suspended from existing support structures such as conventional doorknobs, fences, equipment handles and the like. With particular reference to FIGS. 1–6, a first embodiment of the present invention is disclosed in greater detail wherein the rack or mounting bracket configurations of the present invention are incorporated into a based assembly which may be utilized as a garbage can holder. In this embodiment, the mounting bracket configurations which are generally designated at 20 are shown as being generally elongated rod like members which are mounted to the depending legs 21 of the base 22. The base 22 includes a lower frame 23 which acts to stabilize the legs 21. The uppermost portions of opposing legs 21 are connected by cross members 24 for purposes of further reinforcing the base 22.

Each of the support brackets are 20 includes a pair of elongated bar elements identified at 25 and 26 which are mounted in vertically spaced relationship on the opposite sides of the legs 21 so as to be in staggered or offset horizontal relationship with respect to one another. Do to the slope of the legs 21, it will be noted that the upper bar element 25 will be spaced inwardly with respect to the lower bar element 26. The vertical spacing 27 between each of the bar elements 25 and 26 is just slightly greater than the diameter of the ring elements 30 which are disclosed in greater detail in FIGS. 4–6. The ring elements 30 are preferably formed of the same diameter of material from which the rod like elements 25 and 26 are formed. With specific reference to FIGS. 4–6, it is noted that each ring element includes an inner segment portion 31 which extends into the opening 27 between the rod-like members 25 and 26 and an outer arcuate segment 32 which extends outwardly of the opening 27 and away from the base 22. When the bag mounting rings are positioned within the brackets so as to be between the rods 25 and 26, the upper surface 33 of each ring adjacent the inner arcuate segment 31 will engage the lower surface of the rod member 25 while the lower surface 34 of the ring will engage the upper surface of rod element 26. As the points of engagement between the upper and lower surfaces 33 and 34 of the ring are spaced in horizontal relationship with respect to one another, the rings will be cantilevered outwardly with respect to the support rods without requiring additional fasteners and will be retained under the weight of the outer portion 32 of the ring elements themselves. In this manner, when it is desired to utilize a ring to support a bag or similar container, it is only necessary to either place the bag around the ring and thereafter insert the inner arcuate segment 31 of the ring into the opening 27 between the bars 25 and 26 or insert the segment 31 in the opening and thereafter secure the bag to the outer cantilevered portion 32 of each ring. The number of rings that may be utilized as reflected in this embodiment may vary between one and four rings.

Figure 8:
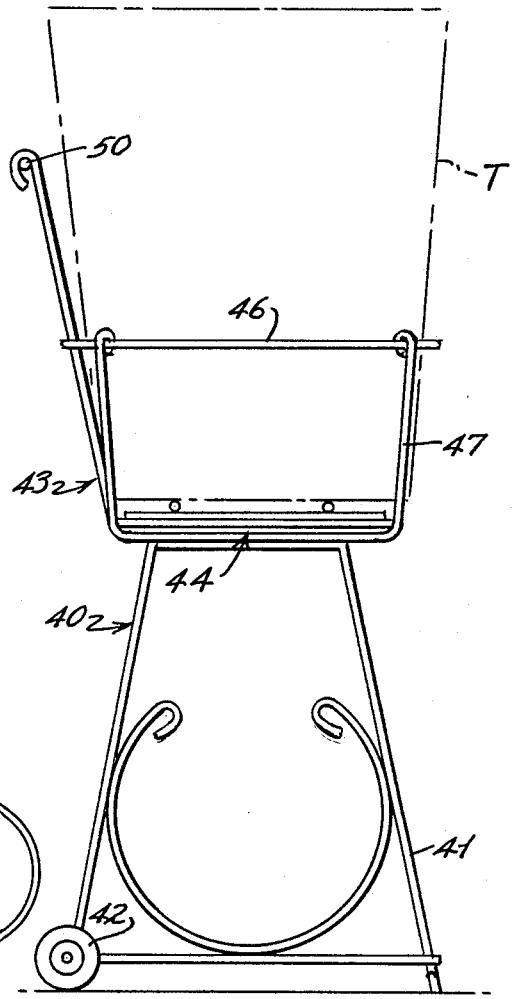
FIG. 8 is an illustrational view showing the embodiment of FIG. 7 shown as mounted to a mobile base so that the overall assembly may be wheeled from one area to another.

The modified embodiment with respect to the invention as disclosed in FIGS. 1–6 is disclosed in FIGS. 7 and 8. In this embodiment, a portable trash can support 40 is disclosed having a base member 41 mounted on wheels 42. A trash can retaining assembly 43 is mounted to the upper portion of the base 41 with the assembly 43 including a pair of generally horizontally oriented support brackets 44 being provided on the lower portion thereof. Each of the brackets 44 includes an upper and lower rod like elements 45 and 46 which are spaced so as to form an opening therebetween as shown at 47. As with the embodiment of FIG. 1, the rods 45 and 46 are horizontally staggered so that the rods 45 are spaced further inwardly with respect to the trash can retaining assembly 43 then are the rods 46. In this manner, the same type of cantilevered configuration may be obtained when the rings of the present embodiment are inserted within the brackets 44 extending along either side of the assembly 43 as was discussed above with respect to FIGS. 1–6. To further stabilize the trash can T which is selectively placed within the assembly 43, an upper stabilizing ring 46 may be secured by vertical brackets 47 to a circular base element 48 that is supported on the upper surface of the bar elements 45 by a pair of cross support members 49. Although not shown in this embodiment of the invention, two additional support brackets 44 may be provided along the front and rear portion of the assembly 43 so as to be in generally parallel alignment with respect to the line of the handle 50 which extends upwardly from the assembly.

The previous embodiments of the present invention have been designed to be utilized with free standing support structures which either may be used separately or concurrently with a trash can type of support. When used with conventional trash can types of supports such as disclosed in applicants prior U.S. design Pat. Nos. 246,848, 248,364 and 252,441 and U.S. Pat. No. 3,520,505, the brackets will allow bags to be vertically oriented in an open configuration with respect to such storage racks so that bags may be filled with debris and thereafter placed within containers which are mounted to such racks. Again, when it is not necessary to support bags from the garbage can holders, the rings may be simply removed from their cantilevered engagement with the support brackets of the trash can supports.

Figure 9:
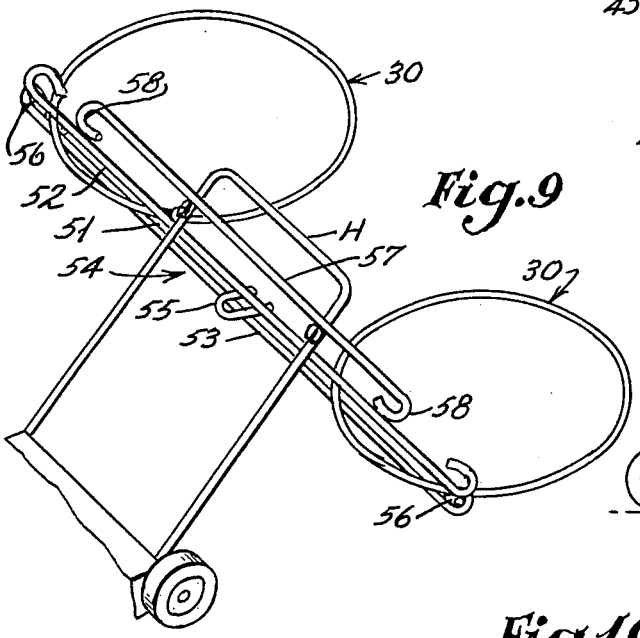
FIG. 9 is yet another embodiment of the present invention showing a mounting bracket which is secured by a hanger bracket that suspends the mounting bracket from the handle of a conventional lawn mower so that a pair of ring elements may be cantilevered therefrom as illustrated.

Another embodiment of the present invention is shown with reference to FIG. 9. In this embodiment, a pair of support rings 30 are shown as being mounted within an opening 51 formed between the upper and lower rods 52 and 53 of the mounting bracket 54. Each of the bar elements 52 and 53 are shown as being elongated with respect to the rods disclosed in the embodiment of FIGS. 1–8. In this manner, the outer portions of each of the rods will extend outwardly on either side of a conventional lawn mower handle shown at H. Each of the rod elements 52 and 53 is joined generally centrally by a spacer element 55 which is oriented generally centrally thereof and are also joined at their outermost end portions by similar spacer elements 56. Each of the spacer elements will act to assure the proper offset alignment of the rods with respect to one another in much the same manner as was discussed above with respect to the embodiments of FIGS. 1–8. As with the previous embodiments, the rods 52 will be horizontally oriented more closely to the handle H than are the offset bars 53 so that when the rings 30 are placed in the space 51 between the upper and lower bars, the rings will be cantilevered in the same manner as was discussed above with respect to the embodiments of FIGS. 1–8.

In order to suspend the bracket 54 from the lawn mower handle H, a separate suspension or hanger rod 57 is joined so as to be in generally parallel relationship with respect to the uppermost rod 52 of the mounting bracket. The suspension rod 57 includes outer portions 58 which extend down and are welded or otherwise secured to the bar member 52. As shown in FIG. 9, the bracket 54 will be suspended from the lawn mower handle as the hanger rod 57 engages the controls positioned on either side of the lawn mower handle.

Figure 10:
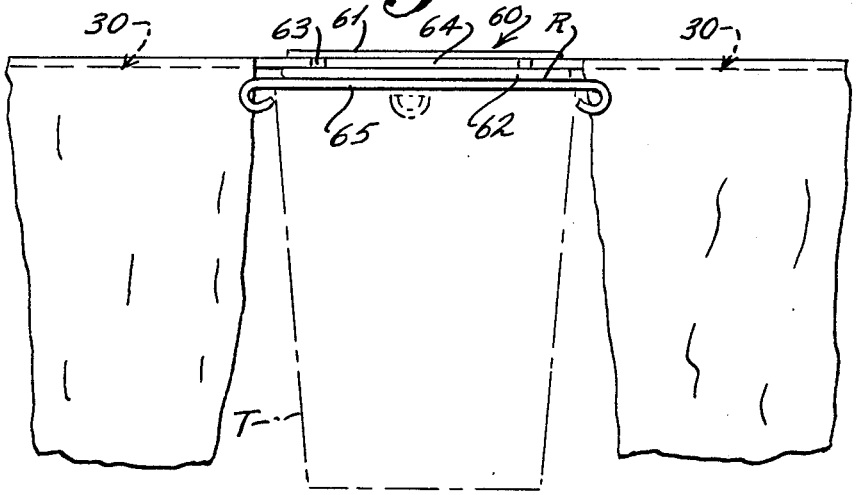
FIG. 10 is another embodiment of the present invention showing the mounting bracket being formed as a pair of vertically spaced ring-like elements which are carried by support arms that are mounted across the opening of a conventional garbage can.
Figure 11:
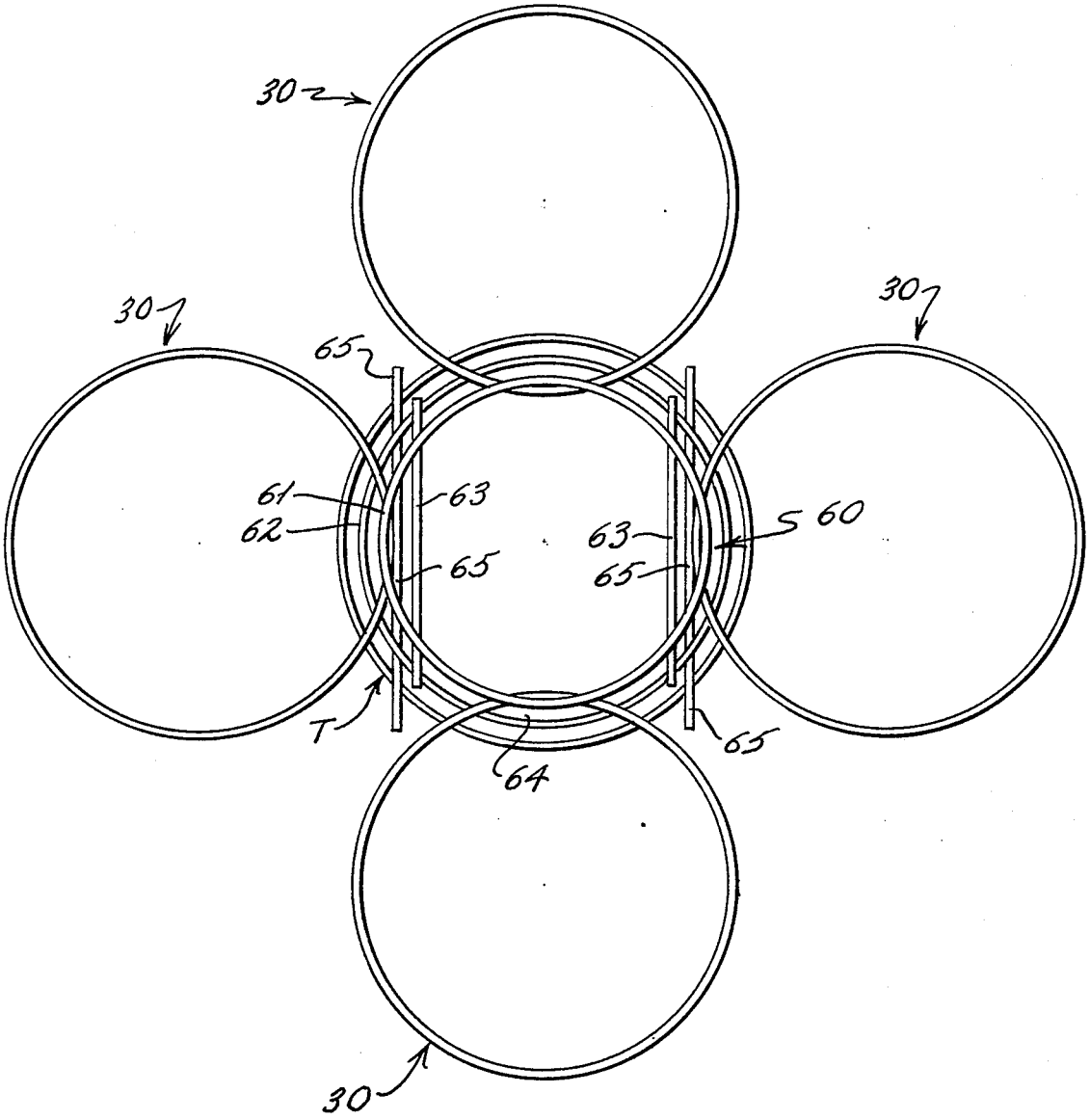
FIG. 11 is an enlarged top plan view of the embodiment shown in FIG. 10 showing four rings supported from the rack assembly.
Figure 12A:
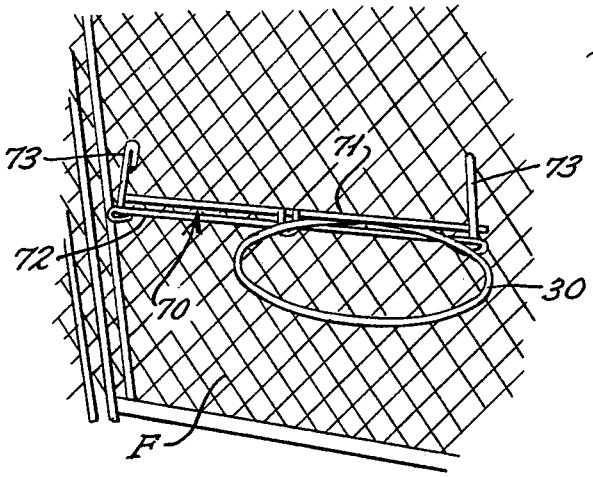
FIG. 12*a* is a front plan view of another embodiment of the present invention showing the rack mounting bracket being suspended from a conventional support structure such as a fence.
Figure 12:
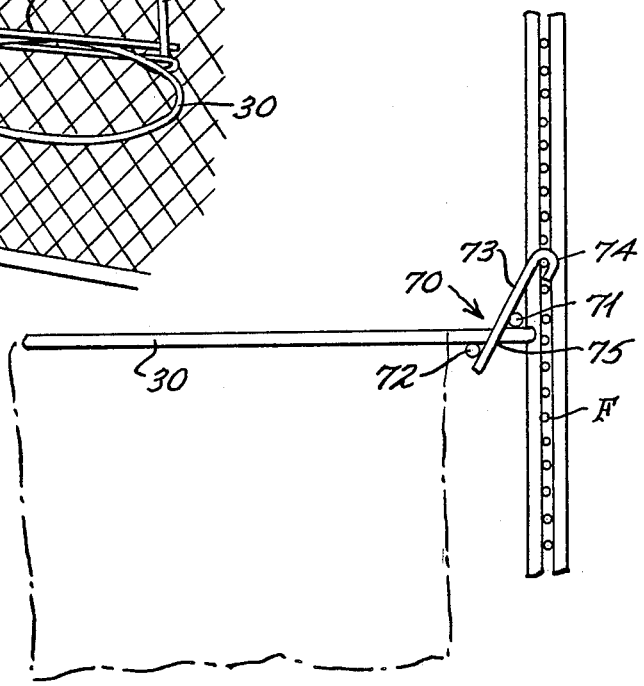
FIG. 12 is a side elevational view of the embodiment of FIG. 12*a*.
Figure 13A:
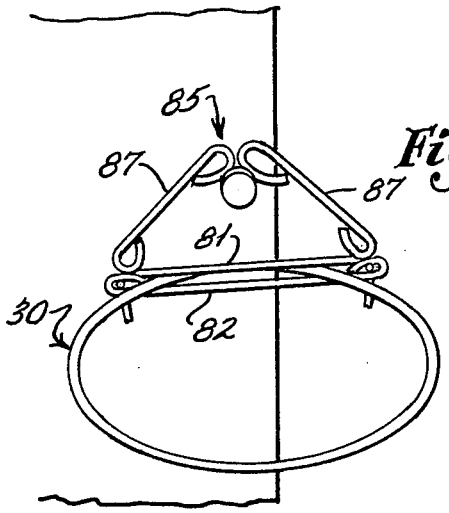
FIG. 13*a* is a front plan view of another embodiment of the present invention showing the support rack being mounted or suspended from a conventional doorknob.
Figure 13:
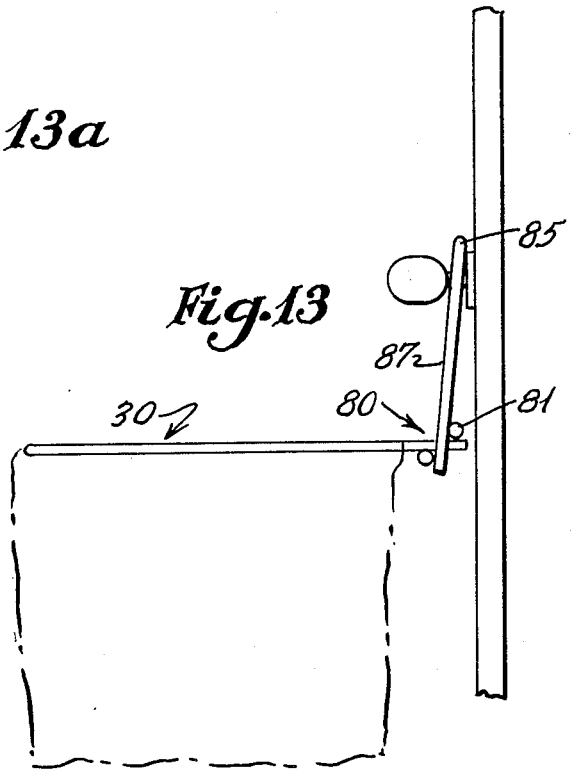
FIG. 13*b* is a side elevational view of the embodiment of FIG. 13*a*.

With reference to FIGS. 10 and 11 of the drawings, another embodiment of the present invention is shown in greater detail. In this embodiment, the mounting brackets are identified at 60 with the rings being identified at 30. In this embodiment, the assemblies are generally designed to be utilized together with an existing conventional trash can T so that the trash can provides support for the bracket assembly and the bag support rings. The bracket assembly 60 includes a pair of vertically and horizontally spaced ring elements 61 and 62 respectively which are spaced by a plurality of spacer members 63. As is shown, the ring member 61 is spaced inwardly with respect to the outer ring member 62 and is vertically elevated with respect thereto. In this manner, the space 64 formed between the ring elements will be similar to the space 27 formed between the bar elements 25 and 26 in FIG. 1 so that when the rings 30 are positioned within the openings 64, the outer ends of the rings will be cantilevered in the same manner as was previously discussed with regard to the first embodiment of the invention. The bracket assembly 60 is supported on an upper rim R of the trash can by providing a pair of generally parallel support rods 65 which are welded or otherwise secured to the lower surface of the ring element 62. Each of these rods 65 extend outwardly on either side of the opening to the rim to the trash can and thereby stabilizes the bracket assembly **60*b*** with respect to the rim.

With specific reference to FIGS. **12*a* and 12*b* yet another embodiment of the present invention is disclosed in greater detail. In this embodiment, the bracket assembly 70 is shown as being specifically designed for mounting to an existing wire mesh fence F. In this embodiment, the bracket assembly includes upper and lower bars 71 and 72 which are spaced in vertical and horizontal relationship by a pair of hook elements 73 which are secured adjacent each end of the bar elements. The uppermost end of the hook elements includes curved portion 74 which is selectively engageable through the wire of a wire mesh or similar type fence. As with the previous embodiments, the upper rod 71 of the support bracket is spaced in closer proximity to the supporting wire mesh structure than is the outer rod 72 so that when a bag support ring 30 is positioned in the space 75 therebetween the ring will be cantilevered outwardly as was discussed with respect to the embodiment of FIGS. 1–6**.

With reference to FIGS. **13*a* and 13*b* another embodiment of the present invention is disclosed. In this embodiment, the mounting bracket 80 is specifically designed to allow the bag support ring 30 to be suspended from a conventional doorknob. In this embodiment, the upper bracket support rod 81 is spaced in closer proximity to the door and vertically above the lower bracket rod 82 so that the opening 83 therebetween will allow the cantilevering of the ring element 30 as was previously discussed. In order to support the bracket 80 from the doorknob, a hanger assembly 85 is provided which incorporates an upper element 86 which is engageable over the doorknob and which has outer extending leg portions 87 which are secured adjacent the outer ends of each of the rods 81 and 82** thereby insuring that the rods of the bracket assembly are retained in their vertically and horizontally staggered relationship.

With each of the embodiments of the present invention, by varying the vertical distance between the support rods of the bracket assemblies, it is possible to vary the angle of inclination of the bag retaining rings 30 with respect to the bracket assembly. It is generally preferred that the rings be horizontal or angled at a slight acute angle below horizontal. If too great of an inclination is provided, the weight of the rings themselves could cause the rings to slide from their cantilevered engagement with the support brackets. This would especially be true when a load is placed on the rings by placing refuse or other material within the bags supported by the ring elements.

As previously discussed, conventional types of lawn and garden or trash bags may be supported by the ring elements with the bags being secured by the use of separate clips such as clothes line clips.

As was previously discussed, in the use of the present invention, the bag retaining rings 30 may be stored in a flat configuration and when placed into use may be utilized interchangeably with any of the support brackets disclosed in the foregoing embodiments of the invention. Each of the mounting brackets is specifically designed to be utilized without modification to the support structure to which the overall bag support assembly is to be utilized. Whether or not the apparatus is to be suspended from a free-standing base or an existing fence, door, trash can or other structure, a solid support will be provided for cantilevering the support rings of the present invention so that the rings may be utilized to securely retain flexible open mouth bags in a vertically stabilized position so as to facilitate the loading of materials into such containers.

I claim:

1. An apparatus for retaining refuse bags in an open and vertically elevated orientation with respect to a support structure comprising a bracket assembly having at least one pair of upper and lower vertically spaced bracket members, spacer means for spacing said bracket members in horizontally offset relationship with respect to one another so that said upper bracket member is in closer proximity to the support structure than said lower bracket member, at least one ring element having first and second arcuate segments, said first arcuate segment being smaller than said second arcuate segment, said first arcuate segment of said ring element being selectively seated between said upper and lower bracket members so that said second arcuate segment is cantilevered outwardly therefrom so that a refuse bag may be selectively supported by said ring element.

2. The apparatus of claim 1 in which said bracket members are generally straight elongated rods having end portions, one of said spacer means connecting said rods generally intermediate their length, and a hook member connected adjacent each end portion of said rods and extending outwardly therefrom, each of said hook members being selectively engageable with the support structure.

3. The apparatus of claim 2 including a pair of said ring elements, one of said ring elements being selectively cantilevered from between said rods on either side of said spacer means.

4. The apparatus of claim 1 in which said bracket members include first and second elongated rods having end portions which are joined by said spacer means, and a hanger element having a central portion extending outwardly relative to and intermediate the length of said elongated rods, said hanger element having spaced ends which are mounted adjacent to said end portions of said elongated rods.

5. The apparatus of claim 1 in which said bracket members having end portions, an elongated hanger element oriented in vertically spaced relationship to said upper bracket member and having opposite ends, and said opposite ends of said hanger element being secured to said upper bracket member.

6. The apparatus of claim 5 in which said spacer means is spaced intermediate the length of said bracket members, and a pair of ring members supported between said bracket members on opposite sides of said spacer means.

7. The apparatus of claim 1 in which said upper and lower bracket members are formed as continuous rings, said upper ring having a diameter which is lesser than the diameter of said lower ring, and a pair of mounting members extending downwardly from said lower ring member which are engageable with the support structure.

8. The apparatus of claim 7 in which said spacer means define four openings between said upper and lower rings whereby four of said ring elements may be selectively mounted within said upper and lower rings.

9. The apparatus of claim 1 including a base assembly, said base assembly having a plurality of vertically extending legs, one said bracket assemblies being mounted between at least one pair of legs of said base assembly whereby at least one ring element may be supported by said base assembly.

10. The apparatus of claim 1 including a base having a plurality of leg elements, a trash can support mounted on said base, said trash can support having a lower portion including said bracket assembly being disposed between two of said leg elements.

* * * * *